United States Patent [19]

Davis et al.

[11] Patent Number: 4,470,267

[45] Date of Patent: Sep. 11, 1984

[54] ADJUSTABLE TEMPERATURE SENSITIVE DUTY CYCLING FURNACE AND AIR CONDITIONER CONTROL SWITCH

[76] Inventors: Raymond K. Davis, 40 Edgewood Dr.; Marion C. Burns, 111 Heiner Heights, both of Lawrenceburg, Ind. 47025

[21] Appl. No.: 473,573

[22] Filed: Mar. 9, 1983

[51] Int. Cl.[3] ..... F25B 1/00; F25B 19/00

[52] U.S. Cl. ..... 62/229; 62/231; 236/46 R

[58] Field of Search ..... 165/12; 236/46 R; 62/231, 229

[56] References Cited

U.S. PATENT DOCUMENTS

| | | | |
|---|---|---|---|
| 3,921,899 | 11/1975 | Hamilton . | |
| 3,925,680 | 12/1975 | Dixon | 307/39 |
| 4,024,411 | 5/1977 | Bengoa | 307/41 |
| 4,136,730 | 1/1979 | Kinsey . | |
| 4,141,407 | 2/1979 | Briscoe et al. | 165/12 |

OTHER PUBLICATIONS

"Power and Fuel Savings with Central Air-Conditioners and Furnaces".

*Primary Examiner*—William E. Wayner

*Attorney, Agent, or Firm*—Wood, Herron & Evans

[57] ABSTRACT

A duty cycling switch for use with a furnace which mounts onto the exterior wall of the furnace plenum and opens and closes in response to the temperature of the plenum wall. The switch is adjusted to deactivate the burner when the plenum wall heats up to a temperature caused by the continuous operation of the burner for a predetermined period of time. The duty cycling switch acts to reactivate the burner when the plenum cools down below this temperature. A duty cycling switch for use with an air conditioner is also disclosed which mounts onto the plenum wall and opens and closes in response to the temperature of the plenum wall. It is adjusted to deactivate the compressor of an air conditioner unit when the plenum wall cools down to a temperature caused by continuous operation of the compressor for a first predetermined period of time and reactivates the compressor after the plenum wall exceeds this temperature. The furnace duty cycling switch is preferably an adjustable bimetal switch which opens on rise. The air conditioner duty cycling switch is a bimetal switch which closes on rise.

4 Claims, 6 Drawing Figures

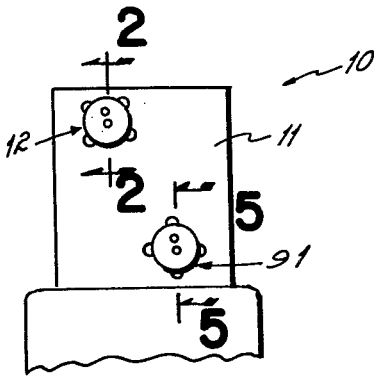
FIGURE 1
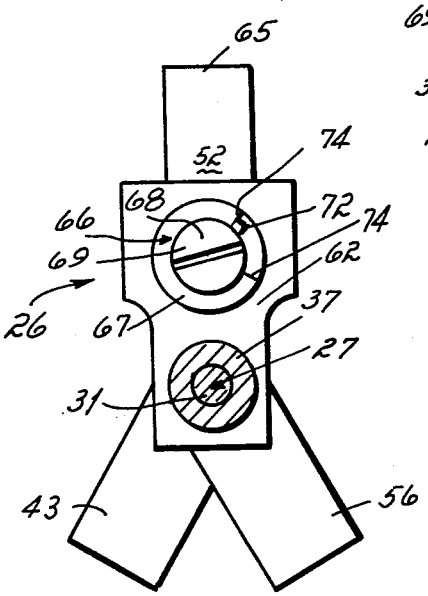
FIGURE 3
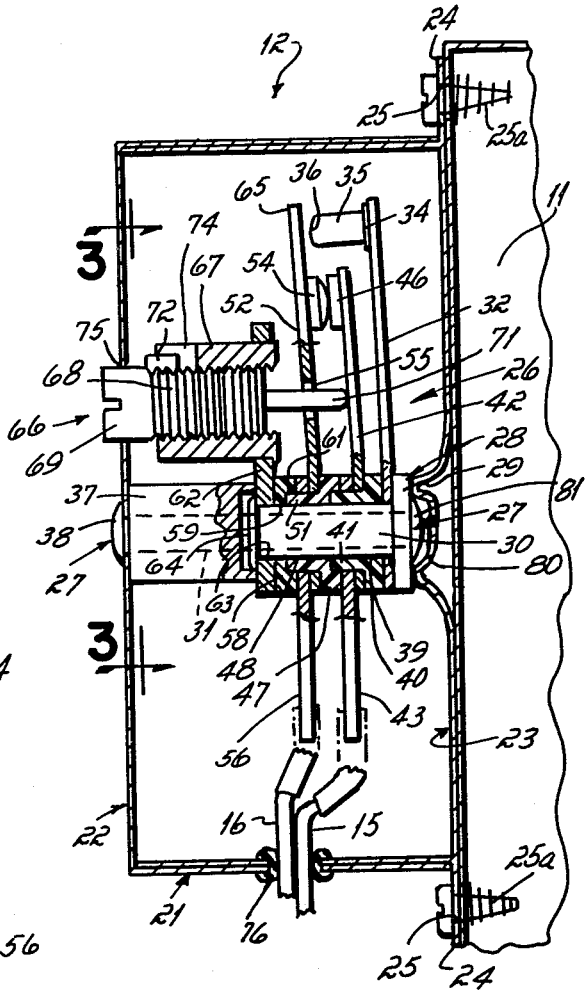
FIGURE 2
FIGURE 3
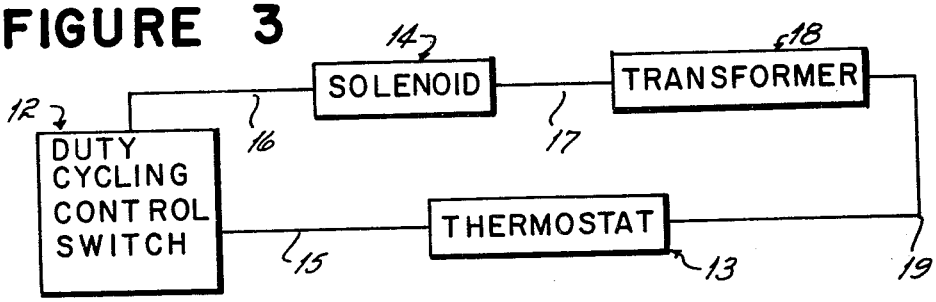
FIGURE 4

ADJUSTABLE TEMPERATURE SENSITIVE DUTY CYCLING FURNACE AND AIR CONDITIONER CONTROL SWITCH

The present invention relates to furnace and air conditioner control switches and more particularly, to temperature sensitive furnace and air conditioner control switches for activating and deactivating a fuel valve on a gas or oil fired forced air furnace or the compressor of a central air conditioner. The invention further relates to a method of controlling the burn cycle in a furnace to more efficiently utilize the fuel and the heat generated from the fuel and a method of controlling the cooling cycle of an air conditioner to improve efficiency.

A typical forced air furnace includes a firebox where a fuel, such as oil or more commonly, natural gas, is burned to create heat. The hot combustion products are circulated in heat exchangers through the plenum, thereby heating the air within the plenum. The blower then draws air from an area which is being heated, such as the interior of a house, into the plenum into contact with the heat exchangers so that the heat in the heat exchangers is drawn off. The blower forces this heated air back into the area being heated.

The burner is activated by a thermostat. The blower is activated by a heat sensing switch in the heat exchanger. This switch activates the blower when the heat exchanger reaches a certain temperature. The blower continues until the heat exchanger is no longer at or above this temperature. The blower would typically continue even after the burner is shut off to utilize residual heat in the heat exchanger.

In a furnace, the fuel will typically continue to burn until the temperature in the area to be heated is hot enough to cause the thermostat to deactivate the furnace. This presents a problem when this area is not heated quickly. The efficiency of a furnace falls off substantially after the burner has been activated for periods longer than about five minutes. Such difficulties are discussed, for example, in Kinsey U.S. Pat. No. 4,136,730 and Hamilton U.S. Pat. No. 3,921,899. The reason for this inefficiency is that the longer the heater is on, the hotter the air in the heat exchanger becomes. After a period of time, the air is so hot that the burning no longer efficiently increases the heat exchanger temperature. The hot combustion products simply pass through the heat exchanger up the chimney. Studies have indicated that after five minutes of burning, the heat exchanger temperature is generally at its most efficient operating temperature.

Kinsey U.S. Pat. No. 3,136,730 discloses a method to improve efficiency by running the burner for only a preset period of time and then restarting the burner after a second preset period of time. This may be effective for new units which can be designed for a particular house and a particular plenum. But establishing what the preset periods of time should be for an existing unit could be virtually impossible. For example, if, in a particular house, the furnace plenum cools down much more quickly than in another house, merely using a timing circuit does not provide sufficient control tailored to that particular home and that particular furnace. Further, this method fails to take into consideration variations in ambient conditions which also effect the rate at which a plenum cools down. Accordingly, using a burner control method of this type could cause air which is either too cold or too hot to be blown around the house.

Hamilton U.S. Pat. No. 3,921,899 discloses a temperature sensing duty cycling switch which attaches to the plenum and controls the flow of gas to the burner of a furnace in response to the temperature of the inside of the plenum. When the temperature is below a certain temperature, the burner can be activated. If plenum temperature exceeds a certain temperature, the burner is deactivated. Although the system disclosed in the Hamilton reference measures temperature, it fails to provide a means to shut the burner off after five minutes. This is extremely important when modifying an existing heating system. Further, because this system utilizes a temperature probe inserted into the plenum, it could be responsive to the wrong reading. Since temperatures within the plenum vary from location to location within a plenum, the positioning of the probe is critical. This is a particular problem where the control system is used to retrofit an existing furnace or where the temperature probe is not designed for a particular unit. Also, if studies were conducted to determine precisely where the temperature probe should be located for a particular furnace, errors could arise in the installation. It is further considered to be undesirable to position a temperature sensing probe within the plenum. In this area, it is subjected to air, dust, and other contaminants which could affect the workings of the system.

A typical central air conditioning unit includes a compressor which cools a series of coils which in turn cool the air within the plenum. Air blown through the plenum is cooled and is subsequently blown into the area being cooled. The compressor is activated by an electrical current or signal received from a thermostat, and the blower is independently activated by a temperature sensitive switch mounted in or near the plenum. The blower typically continues to run even after the compressor is shut off to utilize residual cooling in the coils and plenum.

When an air conditioner is being used to cool an area, the compressor will typically continue to run until the temperature in the area being cooled is cool enough to cause the thermostat to deactivate the compressor. This again presents a problem when the area being cooled is not cooled quickly. The compressor produces a great deal of moisture on the cooling coils which are next to the plenum and which cool the plenum. The moisture in these coils can produce further cooling by evaporation. After about 15 minutes, the coils are completely loaded with moisture. Additional moisture simply goes down the drain. In order to make use of this cooling, the compressor should not operate for longer than about 15 minutes.

With respect to an air conditioner, the Kinsey U.S. Pat. No. 3,136,730 reference discloses a method to improve efficiency by running the compressor for only a preset period of time and then restarting the compressor after a second preset period of time. For example, the first predetermined period of time is estimated to be the time required to load the coils with moisture. The second predetermined period of time is set to allow this moisture to evaporate. The method disclosed in the Kinsey reference particularly fails to accurately establish that second predetermined period of time when the compressor should be reactivated. If the moisture on a particular day in a particular house evaporates extremely quickly, the preset period of time will be too long. On the other hand, if the moisture does not evaporate quickly, the preset period of time could be too short.

Accordingly, it is an object of the present invention to provide means to control the burn cycle of a furnace to maximize its efficiency by controlling the duration of burn so that the burner is deactivated upon burning for about 5 minutes which causes the heat exchanger to reach its most efficient operating temperature and to deactivate the burner whenever the heat exchanger reaches this operating temperature. It is further an object of the present invention to provide a means to reactivate the burner once the heat in the plenum reaches a certain lower temperature.

In an air conditioning system, it is an object of the present invention to control the running cycle of a compressor to run the compressor only for a first predetermined period of time permitting the coils to load up with moisture and then to deactivate the compressor while the blower is allowed to continue to operate. It is a further object of the invention to reactivate the compressor when the plenum heats up to a certain temperature.

It is also an object of the present invention to provide systems which are designed to work with any existing forced air furnace or central air conditioning system, and which are not particularly affected by the design of the plenum, the positioning of the device used to accomplish these objectives and wherein the device is not placed within the plenum where it is subjected to contaminants. Finally, it is an object of the present invention to provide for all of the above objectives using duty cycling switches which are extermely easy to install, simple and inexpensive.

In a heating system, these objectives are attained by connecting an adjustable temperature sensitive switch in-series between the thermostat and the solenoid of the fuel valve. The switch is mounted within a thermally conductive box and simply mounted onto the exterior wall of the plenum. The switch, when connected in-series between the thermostat and the solenoid of the fuel valve, is adjusted while mounted on the plenum wall and during operation so that it deactivates or turns off the fuel flow at the temperature the plenum is heated to after the burner has been activated for a predetermined period of time. At this predetermined period of time, the plenum should be at about its most efficient operating temperature. Heating the heat exchanger to a higher temperature would decrease efficiency.

The operation of this duty cycling switch is premised on the fact that the temperature of the heat exchanger, after five minutes of continuous burning, is at the highest temperature the heat exchanger should be allowed to reach. This, of course, is an empirical determination. The invention is further premised on the fact that the temperature sensed by the duty cycling switch, when mounted on the plenum, is directly proportionate to the temperature of the heat exchanger. Thus, whenever the heat exchanger temperature reaches the highest desirable temperature, the adjusted duty cycling switch senses this and opens. Further, the switch reactivates the fuel flow when the wall of the plenum is less than this highest desirable temperature.

These objectives are attained in an air conditioning system by mounting an adjustable temperature-sensitive switch on the plenum connected in-series between the thermostat and the compressor activation means or switch. The temperature sensitive switch, when connected in-series between the thermostat and the compressor activation means or switch, is adjusted while mounted on the plenum wall and during compressor operation to open and deactivate the compressor when the plenum is at the temperature it reaches after a predetermined period of continuous compressor operation. Further, the switch will repeatedly deactivate the compressor whenever the plenum is at this temperature. Further, the switch reactivates the compressor after the walls of the plenum have exceeded this temperature.

This invention is further premised on the realization that with a central air conditioning system, the wall of the plenum always reaches about the same temperature after 15 minutes of compressor operation. When the plenum is at this temperature, the cooling coils should be completely loaded with moisture. Therefore, according to the present invention, an adjustable temperature sensitive switch is mounted to the plenum wall and adjusted to deactivate the compressor at the temperature of the plenum wall after 15 minutes of compressor operation. The temperature sensitive switch reactivates the compressor when the plenum warms up. A further understanding of the invention can be obtained from the following drawings and detailed description of the invention.

BRIEF DESCRIPTION OF THE DRAWINGS

FIG. 1 is a diagrammatic view of a plenum incorporating a novel furnace duty cycling control switch and a novel air conditioning duty cycling control switch;

FIG. 2 is a cross sectional view of the novel furnace duty cycling control switch taken at line 2—2 of FIG. 1;

FIG. 3 is a cross sectional view of the novel furnace duty cycling control switch taken at line 3—3 of FIG. 2;

FIG. 4 is a circuit diagram showing a furnace system including a duty cycling control switch;

DETAILED DESCRIPTION

Figure 5:
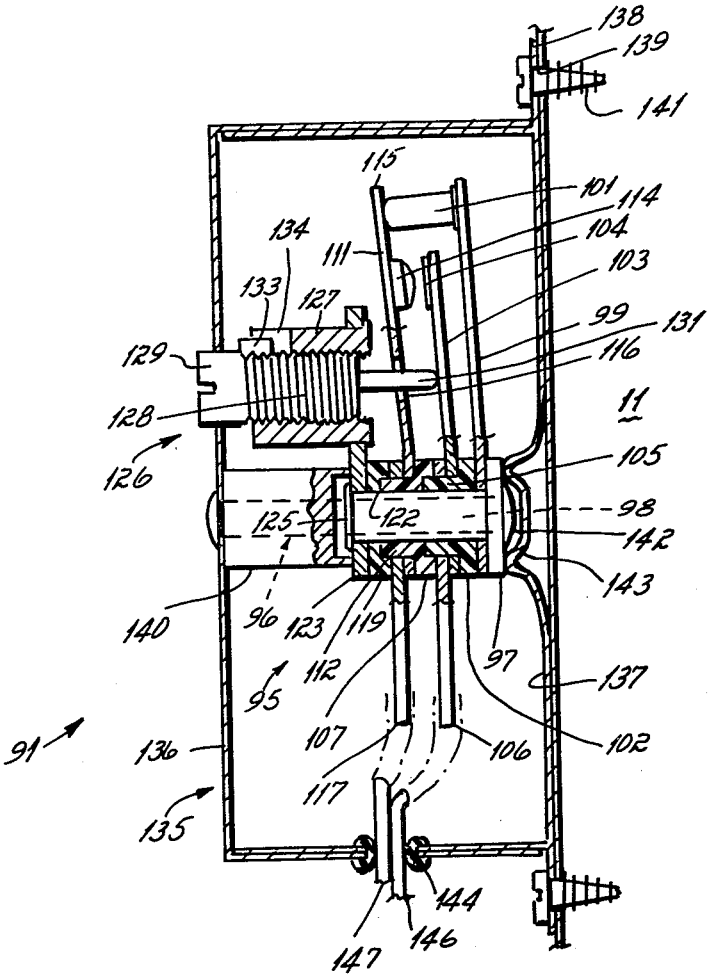
FIG. 5 is a cross sectional view of the air conditioning duty cycling control switch taken at line 5—5 of FIG. 1.

The following describes the duty cycling switch of the present invention as it is connected to a heating system and an air conditioning system. The heating and air conditioning systems per se do not form part of the present invention. The invention provides a means to retrofit an existing system or can be installed with a new system.

As shown diagrammatically in FIG. 1, there is a heating/air conditioning system 10 including a plenum 11 having heat exchangers and air conditioning coils (not shown). Mounted on the plenum is a furnace duty cycling control 12 and an air conditioning duty cycling control 91. The furnace duty cycle control 12 is wired in an electric circuit in-series between a room thermostat 13 and a solenoid 14 for a solenoid-operated fuel valve by leads 15 and 16 as shown in the electrical diagram FIG. 4. The solenoid valve is then connected via lead 17 to a transformer 18 that forms the power supply, the transformer in turn being connected to thermostat 13 via lead 19. This completes the fuel solenoid valve circuit.

The furnace also includes a blower to force cold air from the air intakes into thermal contact with the heat exchangers below the plenum and through heating ducts to the area being heated. The furnace blower is activated by a temperature sensor mounted within the heat exchanger. The blower operates when the heat exchanger reaches a preselected temperature and continues until the heat exchanger temperature is less than this preselected temperature. Therefore, even if the burner is not operating, the blower may be.

Referring to FIGS. 2 and 3, the duty cycling control mechanism 12 includes a metal casing 21 which includes a cup-shaped top cover 22 mounted to a base plate 23 which includes a mounting flange 24. The flange 24 includes a plurality of holes 25 providing a means to mount the box onto the plenum of the furnace using sheet metal screws 25*a*.

As shown in FIG. 2, the duty cycling mechanism includes a bimetallic switch 26 mounted to the top cover 22 of the metal casing 21 by means of a thermally conductive brass rivet 27. The switch includes a brass holding rivet 28 which has a disc-like brass head 29 and a hollow metallic stem 30. The internal diameter of stem 30 is about equal to the external diameter of the stem 31 of brass rivet 27 permitting the passage of stem 31 of brass rivet 27 through the stem of brass holding rivet 28.

The switch further includes a bimetal strip 32 mounted onto the stem 30 of brass holding rivet 28 and rests against the head 29 of the rivet 28. A non-conductive porcelain post 35 is mounted onto the opposite end 34 of bimetal strip 32. The post 35 further includes pointed tip 36.

A lower non-conductive spacer 39 is mounted on stem 30 through an aperture 40. The spacer 39 further includes an annular boss 41. Mounted on this annular boss 41 and separated from the metal stem 30 is a first lower contact strip 42 and a first lower terminal 43. Contact strip 42 includes a contact or point 46 directed away from the bimetal strip 32. The terminal 43 and contact strip 42 are both metallic, electrically conductive and in contact with each other providing an electrical path from the terminal to the contact 46. The annular boss 42 extends slightly above the first lower terminal 43.

A second non-conductive spacer 47 is mounted on stem 30 through an aperture 48 and nests on the annular boss 41 at an annular recessed area 49. The annular boss 41 acts to maintain the terminal 43 and contact strip 42 out of contact with the metal stem 30.

The second non-conductive spacer 47 also includes an annular boss 51. A second upper contact strip 52 and a second, upper terminal 56 are mounted on this annular boss.

The second contact strip 52 includes a second contact or point 54 directed toward the first point 46. Contact strip 52 further includes a centrally located aperture 55. Both the contact strip 52 and terminal 56 are metallic, electrically conductive and in physical contact with each other providing an electrical path from the terminal to the second contact 54.

A third non-conductive spacer 58 is supported on the stem 30 through aperture 59 and in contact with terminal 56. Spacer 58 rests on annular boss 51 at annular recess 61. Thus, the annular boss 51 maintains the terminal 51 and contact strip 52 out of contact with the metallic stem 30.

A tab 62 is also supported on the stem 30 at an aperture 63. At the end of the stem 30 is an annular rivet point 64 which holds tab 62, spacer 58, terminal 56, contact strip 52, spacer 47, terminal 43, contact strip 42, spacer 39, and bimetal strip 32 compressed together.

The two contact strips 52 and 42 are biased towards each other so that points 46 and 54 are normally in contact providing a complete electrical circuit between terminal 56 and terminal 43. Bimetal strip 32 is positioned so that upon heating, it bends moving post 35 towards an extended portion 65 of the contact strip 52.

Mounted on tab 62 is an adjusting means or control 66. The adjusting means 66 includes a hollow internally threaded metal sleeve 67 attached to tab 62 and an externally threaded set screw 68 within sleeve 67. The set screw 68 has a slotted head 69 adapted to receive the head of a screw driver. Mounted at the opposite end of the set screw 68 is a non-conductive post 71 which extends through the centrally located aperture 55 in contact strip 52 a point adjacent to the contact strip 42. Rotation of the set screw moves the post relative to strip 42 and when rotated in one direction pushes strip 42 away from strip 52 and when rotated in the opposite direction allows strip 42 to move closer to strip 52 thus changing the distance from tip 36 to contact strip 52. This altering the distance of bimetal strip 32 must move to break the contact between the two points 46 and 54 as well as the temperature at which the bimetal switch is opened and closed.

Set screw 68 further includes a radially extended member 73, and internally threaded sleeve 67 includes a raised stop portion 74. Stop portion 74 lies in the path of extended member 73, thereby limiting the degree of rotation of set screw 68.

The switch is mounted by the brass rivet 27 to the cover 22 of metal housing 21. The rivet passes through switch 26, a spacer 37 and cover 22 and is swagged. The tubular spacer 37 holds the switch at a desired distance from the top cover 22 for access to set screw 68. To this end, the top cover 22 further includes an aperture 75 adapted to receive the head 69 of the set screw 68 providing means for adjusting the switch without removing the metal housing and while the housing and switch are mounted to a furnace plenum. The metal housing 21 further includes a rubber grommeted aperture 76 providing a passage for leads 15 and 16 from terminals 43 and 56 through the metal housing.

The lower metal plate 23 of the metal housing 21 includes an annular inwardly raised portion 80 which, in the assembled form, contacts the head 81 of the mounting rivet 27 and provides improved thermal conduction from the metal plenum wall to the metal casing and to the brass rivet 27.

In use, the metal casing of the duty cycling mechanism 12 is attached to the plenum with the mounting plate 23 flush against the outer plenum wall. A plurality of sheet metal screws 25*a* extend through apertures 25 in the mounting flange 24 into the plenum wall holding the duty cycling mechanism in place.

As shown in FIG. 4, the furnace duty cycling control 12 is wired into the thermostat fuel solenoid valve circuit in series between the thermostat 13 and solenoid 14 of the fuel valve. The first lead or wire 15 from thermostat 13 is attached via terminal 56 to the duty cycling control, and the other lead 16 is attached to the terminal 43. To complete the circuit, transformer 18 is included wired between solenoid valve 14 and thermostat 13 via lines 17 and 19. Thus, in a completed circuit in which the thermostat and the duty cycling switch are closed, current is received by the solenoid fuel valve, causing it to open.

To adjust the mounted duty cycling switch, the thermostat should be turned to a relatively high temperature, i.e., at least about 10°–15° higher than room temperature, normally causing the furnace to ignite and burn for an extended period in excess of 5 minutes. The set screw 68 is rotated to break contact between points 46 and 54 after a burn period of about five minutes.

As designed, the burning in the furnace heats the plenum which in turn heats the mounting plate, and finally the bimetal strip which bends toward the contact strips. This in turn brings the porcelain knob or post 35 into contact with the extended portion 65 of contact strip 52 tending to separate the contact strips. The adjustment caused by rotating set screw 68 alters the distance which extended portion 65 must be moved to separate the contacts so that at five minute period, (i.e., the time the set screw 68 is adjusted) the contact is broken. This eliminates the electrical input into the solenoid 14, causing it to close the fuel valve and cutting off the fuel to the burner.

While this is occurring, the blower, which is independently activated, continues to blow cold air into contact with the heat exchanger reducing its temperature and transferring this newly heated air throughout the area to be heated. As the temperature of the heat exchanger decreases, so does the temperature of the plenum. Therefore, the bimetal strip backs away from the contact strips and the points 54 and 46 will again contact each other completing the circuit and initiating the burn, thus creating a cycle. When the temperature in the area being heated is hot enough to satisfy the thermostat, the thermostat will then break the circuit and discontinue the electrical input to valve 14 stopping the burn and stopping the cycle.

The bimetal switch itself is basically an off-the-shelf item which can be purchased having a desired range of effectiveness. Preferably, a slowly responsive switch should be used. The temperature at which the duty cycling switch is reclosed is largely dependent upon the bimetal strip.

The range of temperatures at which the switch can be opened and closed is important for the present invention. When the bimetal strip is in an unaltered state, it extends at almost a 90° angle out from stem 30. A bimetal strip which does not interfere or which extends straight outward from stem 30 at a temperature of about 61° F., adequately insures that the switch will be closed at a temperature of 61° F. or less. A bimetal switch has an upper operating temperature of 250° F. adequately functions within the range of a typical furnace plenum. Many furnaces automatically shut the fuel solenoid valve at this temperature as a safety precaution.

According to the present invention, the furnace is provided with a duty cycling switch which is adjusted at a first predetermined time, i.e. five minutes to open. The switch closes when the switch senses a lower temperature.

The duty cycling switch of the present invention acts to establish the maximum temperature the plenum should be permitted to reach. This is the temperature the plenum reaches after five minutes of continuous burning. Adjusted to turn off at this temperature, the switch will repeatedly open when the plenum reaches that maximum temperature. However, the burner will reactivate when the temperature of the plenum drops a predetermined amount. Thus, the ambient conditions are taken into consideration. Therefore, on a particularly cold day when the plenum cools down quickly, the burner will be reactivated quickly. However, on a warmer day where less heat is being drawn from the house and the temperature cools down more slowly, the burner will remain inactivated for a longer period of time. This system also takes into consideration variations in a particular unit. For example, one unit may have a plenum which cools down extremely quickly. Perhaps more air is being forced through the plenum, or the plenum may be smaller. In this furnace system, the duty cycling control of the present invention would cause the burner to be reactivated very quickly. However, in another furnace where the plenum, due to its design, either its size or the amount of air being blown through the plenum, cools down very slowly, the duty cycling control would react to this and close after a longer period of time.

A second duty cycling control 91 is required for use with an air conditioning system. The primary difference between the furnace duty cycling mechanism and the air conditioning duty cycling mechanism is that the furnace mechanism opens on rise and the air conditioning mechanism closes on temperature rise.

The air conditioning duty cycling mechanism 91 shown in FIG. 5 and the control schematic shown in FIG. 6 includes a normally open switch 95 which is the same as switch 26 except as distinguished below. Switch 95 includes a thermally conductive hollow stem rivet 96 with a disc-like head 97. Position on stem 98 of rivet 96 is a bimetallic strip 99, including a ceramic post 101 and a non-conductive spacer 102. A first contact strip 103, including a contact point 104, is mounted on an annular boss 105 of spacer 102. A first terminal 106 rests on annular boss 105 above and in contact with the first contact strip 103.

Above terminal 106 is non-conductive spacer 107 positioned on rivet 96 through aperture 108 and nested on annular boss 105 through annular recess 109. A second contact strip 111 rests on an annular boss 112 of spacer 107. The second strip 111 includes a contact point 114 at one end thereof, and an overhanging portion 115 extending beyond the contact point 114 as well as a centrally located aperture 116. Also mounted on annular boss 112, in contact with the metal strip 111, is a second terminal 117.

Above terminal 117 is a non-conductive spacer 119 mounted to rivet 96 and nested on annular boss 112 at annular recess 122. A metal tab 123 is mounted on rivet 96 above spacer 109. These components are held tightly together by rivet 96 having an annular head 125.

At the end of the mounting tab is an adjusting means 12 comprising an internally threaded sleeve 127 and an externally threaded adjusting screw 128 within the sleeve. The upper end 129 of the adjusting screw has a slotted head. At the opposite end is a non-conductive post 131 which is forcefit to the end of the adjustment screw and passes through the aperture 116 in contact strip 111 down to contact with first contact strip 103.

In a normally inactive position, where the bimetal strip rests at approximately a 90° angle outward from the stem 98, post 101 contacts overhanging portion 115 of strip 111 preventing the points 114 and 104 from being in contact. The bimetal strip is positioned so that upon heating, the bimetal strip bends away from these contact strips so that post 101 pulls away from the extended portion 115 of contact strip 111. Strips 111 is biased toward strip 103 and will move towards strip 111 until contact is made.

The switch is adjusted by rotating the adjusting screw 128 which moves post 131 upwardly or downwardly relative to the contact strip 111 and alters the distance between strip 103 and strip 111, thereby altering the amount of movement required of the bimetal strip to permit points 104 and 114 to contact each other.

The adjusting screw includes a radially extended member 133 and the sleeve 127 includes a raised portion 134 which lies in the path of rotation of radially extended member 133. These combine to limit the degree of rotation of the adjusting screw 128.

The switch 95 is mounted to a metal housing 135 which is substantially the same as metal housing 21. The housing includes a top 136 and metal base plate 137 including a mounting flange 138 having apertures 139 to permit the passage of mounting screws 14. The switch is held to the top of the housing by metal rivet 142 passing through the hollow stem 98 of rivet 96 and through spacer 140 which maintains switch 91 at a desired distance from top 136.

The base plate 137 includes an annular raised portion 143 which contacts the head of rivet 142. When installed, this improves thermal conduction from plenum wall 11 to bimetal strip 99 making the switch more responsive.

The housing includes a rubber grommeted aperture 144 for wires 146 and 147 connected to terminals 106 and 117, respectively.

Figure 6:
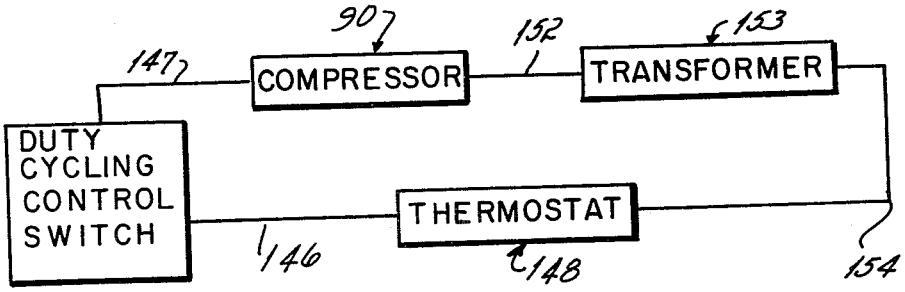
FIG. 6 is a circuit diagram showing an air conditioning system including a duty cycling control switch.

The operation of the switch is shown diagrammatically in FIG. 6 which is a simplified thermostat-compressor wiring diagram. In operation, the compressor receives a 24 volt signal from the thermostat 148 which, in effect, actuates the compressor. When this signal is no longer received, the compressor shuts off.

The switch is wired in the thermostat compressor circuit in-series between the thermostat 148 and the compressor 90. A wire 146 coming from the thermostat 148 is connected to the terminal 106, and wire 47 leading to the compressor 90 is connected to the terminal 117.

As shown in FIG. 6, this circuit is completed by a lead 152 going from the compressor to a transformer 153 and wire 154 from the transformer 153 to the thermostat making a complete circuit. The wire 147 from the switch 95 to the compressor and wire 152 from the compressor actually go to the activation switch of the compressor which activates the compressor upon receipt of electric current from the transformer via the thermostat. Thus, when the switch 95 is closed, electrical current is received by the compressor from the thermostat causing the compressor to operate. Opening switch 95 simply breaks the circuit so that no electric current is received by the compressor to maintain the operation of the compressor.

The switch 95 is mounted on the air conditioner plenum by means of mounting screws 141 passing through holes 139 in mounting flange 138.

The bimetal switch for the air conditioner is designed to operate between 34° F. and 150° F. Therefore, at normal room temperature, for example, about 70° or higher, the switch will be closed, i.e., the bimetal strip will be in a bent position. Again, the particular characteristics of the switch can be changed according to desire. However, these ranges of operation are believed to be the best mode currently known to the inventors. Switches such as these can be purchased which operate within desired ranges.

The switch attached to the plenum as described above is adjusted to limit the duration of the compressor operation to about 15 minutes. This is accomplished by turning the thermostat to a position where the compressor should operate continuously for a period of time in excess of 15 minutes, for example, setting the thermostat at 15° below room temperature. The switch is adjusted by rotating screw 112 so that it remains closed for fifteen minutes and then opens, causing the compressor to stop. The thermostat is turned back to the desired setting and the duty cycling system is in operation.

Thus, in operation, the thermostat will detect a temperature which is higher than desired and will send a signal to activate the compressor. The duty cycling switch should normally be at a closed position. The electrical current from the thermostat will activate the compressor. The compressor in turn will cool down the coils and, thereby the plenum. If the compressor remains on for 15 minutes, the plenum will be so cold that the duty cycling switch 95 as adjusted will open, interrupting the signal from the thermostat to the compressor activation switch, turning the compressor off. The blower, which is independently activated, will continue to blow. This will continue until the temperature of the plenum heats up enough to cause the bimetal strip to bend, closing the switch, which in turn will reactivate the compressor.

Accordingly, the duration of compressor run time is limited to 15 minutes, thereby most efficiently utilizing the compressor and energy required to run the compressor. This 15 minutes is a predetermined period of time. Other periods of time could be selected, but 15 minutes is believed to be optimum. Further empirical determinations could alter this 15 minutes to a certain extent and different designs of compressors could alter the 15 minute period. However, regardless of exactly what the predetermined period of time is, the present invention will act to disconnect the compressor or inactivate the compressor after a first predetermined period of time as established by the time required to cool the duty cycling mechanism as adjusted. The duty cycling mechanism would then act to measure temperature to effect a reactivation of the compressor if the temperature in the plenum reaches a high enough temperature and if the thermostat continues to send a signal to the compressor.

Having described our invention, we claim:

1. An air conditioning system including a plenum, a thermostat, and a compressor activated by a compressor activation means operable in response to electrical current directed from said thermostat and further including a duty cycling temperature sensitive air conditioner compressor control said duty cycling control including a switch having first and second relatively movable contact points providing an electrical circuit from a first terminal to a second terminal when said two contacts are in contact;

said first terminal connected to a lead from said thermostat;

said second terminal connected to a lead to said compressor activation means;

means to move said contact points relative to each other and out of contact at a first lower temperature;

means to move said contact points into contact with each other at a second higher temperature;

a thermally conductive housing;

wherein said switch is mounted in said thermally conductive housing and said housing is mounted to an exterior surface of said plenum; and means to adjust said first lower temperature at which said contacts are moved out of contact while said thermally conductive housing is mounted to the exterior surface of said plenum and said switch is connected in-series between said thermostat and said compressor activation means and while said compressor is operating.

2. The air conditioning system claimed in claim 1 wherein said switch is opened and closed by means of a bimetallic strip.

3. A method of controlling the operation of an air conditioner having a compressor, a plurality of coils, a plenum, a blower to circulate air into contact with said coils to cool said air and transfer said cool air through said plenum to an area to be cooled, said compressor operating in response to an electrical current supplied from a thermostat located in said area to be cooled and wherein operation of said compressor cools said plenum, and an adjustable heat sensitive switch connected in-series between said compressor and said thermostat, said switch mounted on said plenum, said switch opening and closing in response to a variation in the temperature of said plenum wherein said switch interrupts said electrical current to said compressor when a first lower temperature is sensed by said switch, means to activate said blower, said method comprising:

controlling the operation of said compressor so that said compressor does not operate for longer than a predetermined period of time by adjusting said switch to establish said first lower temperature at which said switch interrupts said electrical current to said compressor.

4. A central air conditioning system including a compressor activated by a compressor activation means operable in response to an electric current, a thermostat, a plenum, said compressor when activated acting to reduce the temperature of said plenum, and a duty cycling control for said compressor activation means comprising:

a temperature sensitive switch mounted within a thermally conductive housing;

said switch being adjustable to alter the temperature at which said switch opens and closes;

said switch being connected in-series between said thermostat and the compressor activation means;

said housing mounted onto a wall of said plenum; and means to adjust the switch while said switch is mounted on the wall of the plenum during the operation of the compressor.

* * * * *